US008486499B2

(12) United States Patent
Nito et al.

(10) Patent No.: US 8,486,499 B2
(45) Date of Patent: Jul. 16, 2013

(54) INK JET RECORDING MEDIUM

(75) Inventors: Yasuhiro Nito, Yokohama (JP); Hisao Kamo, Ushiku (JP); Tetsuro Noguchi, Hachioji (JP); Ryo Taguri, Sagamihara (JP); Isamu Oguri, Yokohama (JP); Olivia Herlambang, Kawasaki (JP); Naoya Hatta, Kawasaki (JP); Shinya Yumoto, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 30 days.

(21) Appl. No.: 13/356,103

(22) Filed: Jan. 23, 2012

(65) Prior Publication Data

US 2012/0207950 A1 Aug. 16, 2012

(30) Foreign Application Priority Data

Feb. 10, 2011 (JP) ..... 2011-027544

(51) Int. Cl.
*B41M 5/00* (2006.01)
*B41M 5/52* (2006.01)
*B41M 5/50* (2006.01)

(52) U.S. Cl.
CPC ..... *B41M 5/5218* (2013.01); *B41M 5/52* (2013.01); *B41M 5/5254* (2013.01); *B41M 5/502* (2013.01)
USPC ..... 428/32.24; 428/32.25; 428/32.26; 428/32.28; 428/32.34

(58) Field of Classification Search
CPC ..... B41M 5/5218; B41M 5/52; B41M 5/5254; B41M 5/502
USPC ..... 428/32.24, 32.25, 32.26, 32.28, 32.34
See application file for complete search history.

(56) References Cited

U.S. PATENT DOCUMENTS

| | | | | |
|---|---|---|---|---|
| 4,434,226 | A | 2/1984 | Wilgus et al. | |
| 5,955,185 | A | 9/1999 | Yoshino et al. | |
| 5,965,252 | A | 10/1999 | Santo et al. | |
| 6,874,881 | B2 | 4/2005 | Suzuki et al. | |
| 6,929,362 | B2 | 8/2005 | Takada et al. | |
| 6,932,465 | B2 | 8/2005 | Nito et al. | |
| 6,935,732 | B2 | 8/2005 | Takada et al. | |
| 7,029,109 | B2 | 4/2006 | Shirota et al. | |
| 7,055,943 | B2 | 6/2006 | Suzuki et al. | |
| 7,208,032 | B2 | 4/2007 | Hakamada et al. | |
| 7,276,110 | B2 | 10/2007 | Tsujimura et al. | |
| 7,276,112 | B2 | 10/2007 | Tokuda et al. | |
| 7,347,890 | B2 | 3/2008 | Nito et al. | |
| 7,354,145 | B2 | 4/2008 | Nito et al. | |
| 7,377,631 | B2 | 5/2008 | Takada et al. | |
| 7,402,200 | B2 | 7/2008 | Imai et al. | |
| 7,517,073 | B2 | 4/2009 | Nito et al. | |
| 7,517,074 | B2 | 4/2009 | Hakamada et al. | |
| 7,537,329 | B2 | 5/2009 | Nito et al. | |
| 7,625,614 | B2 | 12/2009 | Kamo et al. | |
| 7,635,182 | B2 | 12/2009 | Hakamada et al. | |
| 7,846,516 | B2 | 12/2010 | Kamo et al. | |
| 7,867,586 | B2 | 1/2011 | Kamo et al. | |
| 8,016,406 | B2 | 9/2011 | Hakamada et al. | |
| 8,153,212 | B2 | 4/2012 | Hyakuda et al. | |
| 8,158,223 | B2 | 4/2012 | Hyakuda et al. | |
| 2007/0202278 | A1* | 8/2007 | Schultz et al. | 428/32.24 |
| 2008/0152827 | A1 | 6/2008 | Hakamada et al. | |
| 2009/0011155 | A1 | 1/2009 | Kamo et al. | |
| 2010/0260939 | A1* | 10/2010 | Foley | 427/385.5 |
| 2011/0076518 | A1 | 3/2011 | Noguchi et al. | |
| 2011/0104411 | A1 | 5/2011 | Oguri et al. | |
| 2011/0135855 | A1 | 6/2011 | Oguri et al. | |
| 2011/0293860 | A1 | 12/2011 | Oguri et al. | |
| 2012/0094039 | A1 | 4/2012 | Taguri et al. | |

FOREIGN PATENT DOCUMENTS

| | | | |
|---|---|---|---|
| JP | 5-016015 | B2 | 3/1993 |
| JP | 7-232473 | A | 9/1995 |
| JP | 8-132731 | A | 5/1996 |
| JP | 9-066664 | A | 3/1997 |
| JP | 9-076628 | A | 3/1997 |
| JP | 2008-265110 | A | 11/2008 |

OTHER PUBLICATIONS

European Search Report dated Jul. 19, 2012, in counterpart European Application No. 12000549.1-1251.

* cited by examiner

*Primary Examiner* — Betelhem Shewareged
(74) *Attorney, Agent, or Firm* — Fitzpatrick, Cella, Harper & Scinto

(57) ABSTRACT

An ink jet recording medium including a substrate and two or more ink receiving layers provided on the substrate, wherein a first ink receiving layer that is an outermost ink receiving layer of the two or more ink receiving layers and a second ink receiving layer adjacent to the first ink receiving layer contain an alumina pigment, polyvinyl alcohol and boric acid. The first ink receiving layer contains polyvinyl alcohol in an amount of 7.0-10.5% by mass or less based on the alumina pigment and contains boric acid in an amount of 1.1-1.4% by mass or less based on the alumina pigment. The second ink receiving layer contains polyvinyl alcohol in an amount of 10.5-17.0% by mass or less based on the alumina pigment and contains boric acid in an amount of 1.5-2.5% by mass or less based on the alumina pigment.

8 Claims, No Drawings

INK JET RECORDING MEDIUM

BACKGROUND OF THE INVENTION

1. Field of the Invention

The present invention relates to an ink jet recording medium.

2. Description of the Related Art

A recording medium having an ink receiving layer on a substrate is known as a recording medium on which recording is conducted according to an ink jet recording method. The ink receiving layer contains an inorganic pigment such as silica or alumina and a binder such as polyvinyl alcohol. Such an ink jet recording medium is required to have high ink absorbency to be adaptable in high-speed printing in recent years.

Japanese Patent Application Laid-Open No. 2008-265110 describes a recording medium having two ink receiving layers as an ink jet recording medium with the ink absorbency improved. In this ink jet recording medium, the binder content in the first ink receiving layer (the layer farther from a substrate) is 4% by mass or more and 6% by mass or less based on alumina hydrate. The binder content in the second ink receiving layer (the layer nearer to the substrate) is 7% by mass or more and 12% by mass or less based on alumina hydrate.

SUMMARY OF THE INVENTION

From the viewpoint of being adaptable in high-speed printing in recent years, conveyance-caused flaw resistance is required in addition to the ink absorbency. In order to conduct the high-speed printing, it is necessary to convey a recording medium at a high speed. When it is intended to improve conveying accuracy while conveying the recording medium at the high speed, the recording medium needs to be conveyed while vertically strongly holding the recording medium between conveying rollers, so the surfaces of the recording medium may have suffered flaw (conveyance-caused flaw) by the conveying rollers in some cases. According to an investigation by the present inventors, there has been room for improvement in resistance to such flaw (conveyance-caused flaw resistance) on the recording medium described in Japanese Patent Application Laid-Open No. 2008-265110.

Accordingly, it is an object of the present invention to provide an ink jet recording medium with improved ink absorbency and conveyance-caused flaw resistance.

The above object can be achieved by the present invention described below. The present invention thus provides an ink jet recording medium comprising a substrate and two or more ink receiving layers provided on the substrate, wherein a first ink receiving layer that is an outermost ink receiving layer of the two or more ink receiving layers and a second ink receiving layer adjacent to the first ink receiving layer contain an alumina pigment, polyvinyl alcohol and boric acid, the first ink receiving layer contains polyvinyl alcohol in an amount of 7.0% by mass or more and 10.5% by mass or less based on the alumina pigment and contains boric acid in an amount of 1.1% by mass or more and 1.4% by mass or less based on the alumina pigment, and the second ink receiving layer contains polyvinyl alcohol in an amount of 10.5% by mass or more and 17.0% by mass or less based on the alumina pigment and contains boric acid in an amount of 1.5% by mass or more and 2.5% by mass or less based on the alumina pigment.

According to the present invention, there can be provided an ink jet recording medium improved in ink absorbency and conveyance-caused flaw resistance. Further features of the present invention will become apparent from the following description of exemplary embodiments.

DESCRIPTION OF THE EMBODIMENTS

The recording medium according to the present invention will now be described in detail by preferred embodiments. The recording medium according to the present invention has a substrate and two or more ink receiving layers provided on the substrate.

Substrate:

Examples of the substrate include paper such as cast-coated paper, baryta paper and resin-coated paper (resin-coated paper with both surfaces thereof coated with a resin such as polyolefin), and films. Among the above-described substrates, the resin-coated paper is favorably used from the viewpoint of glossiness after the formation of the ink receiving layers. As the films, may be favorably used films of transparent thermoplastic resins such as, for example, polyethylene, polypropylene, polyester, polylactic acid, polystyrene, polyacetate, polyvinyl chloride, cellulose acetate, polyethylene terephthalate, polymethyl methacrylate and polycarbonate. Besides the above, waterleaf paper or coat paper that is moderately sized paper, or a sheet-shaped material (synthetic paper or the like) formed of a film opacified by filling an inorganic material or by fine foaming may also be used. In addition, a sheet formed of glass or a metal may also be used. The surfaces of these substrates may also be subjected to a corona discharge treatment or various undercoating treatments for the purpose of improving adhesion strength between such a substrate and the ink receiving layer.

Ink Receiving Layer:

The ink jet recording medium according to the present invention has two or more ink receiving layers on the substrate. Among the two or more ink receiving layers, an ink receiving layer present on an outermost side (at a position most distant from the substrate) is referred to as a first ink receiving layer. An ink receiving layer adjacent to the first ink receiving layer is referred to as a second ink receiving layer. In short, the second ink receiving layer is present adjacently to the substrate side surface of the first ink receiving layer.

The first and second ink receiving layers contain an alumina pigment, polyvinyl alcohol and boric acid.

Alumina Hydrate:

The alumina pigment used in the present invention includes alumina hydrate. As the alumina hydrate, is favorably used that represented by the following general formula (X):

$$Al_2O_{3-n}(OH)_{2n}.mH_2O \quad (X)$$

(in the formula, n is any one of 1, 2 and 3, and m is a value falling within a range of from 0 to 10, favorably from 0 to 5. However, m and n are not 0 at the same time. In many cases, $mH_2O$ represents water which does not participate in the formation of a crystal lattice, and is eliminable, and so m may take an integer or a value other than an integer. When this alumina hydrate is heated, m may reach a value of 0 in some cases.).

As the crystal structure of the alumina hydrate, are known amorphous, gibbsite and boehmite types according to the temperature of a heat treatment. That having any crystal structure among these may be used as the alumina hydrate. Among these, favorable alumina hydrate is alumina hydrate exhibiting a beohmite structure or amorphous structure when analyzed by the X-ray diffractometry. As specific examples thereof, may be mentioned the alumina hydrates described in Japanese Patent Application Laid-Open No. H07-232473, Japanese Patent Application Laid-Open No. H08-132731, Japanese Patent Application Laid-Open No. H09-66664 and Japanese Patent Application Laid-Open No. H09-76628. Among these alumina hydrates, such an alumina hydrate that the average pore radius in the whole ink receiving layer amounts to 7.0 nm or more and 10.0 nm or less when the ink receiving layers are formed is favorably used. Such an alumina hydrate that the average pore radius amounts to 8.0 nm or more is more favorably used. When the average pore radius in the whole ink receiving layer is 7.0 nm or more and 10.0 nm or less, excellent ink absorbency and colorability can be exhibited. If the average pore radius in the whole ink receiving layer is less than 7.0 nm, the ink absorbency is insufficient, so that sufficient ink absorbency may not be achieved in some cases even when the amount of the binder to the alumina hydrate is controlled. If the average pore radius of the whole ink receiving layer is more than 10.0 nm, haze of such an ink receiving layer becomes great, and good colorability may not be achieved in some cases. In addition, it is favorable that a pore whose pore radius is 25.0 nm or more is not present in the ink receiving layer. If the pore whose pore radius is 25.0 nm or more is present, haze of the ink receiving layer becomes great, and good colorability may not be achieved in some cases.

The pore volume in the whole ink receiving layer is favorably 0.50 ml/g or more in terms of total pore volume. If the total pore volume is less than 0.50 ml/g, the ink absorbency of the whole ink receiving layer is insufficient, so that sufficient ink absorbency may not be achieved in some cases even when the amount of polyvinyl alcohol to the alumina hydrate is controlled. The total pore volume is also favorably 30.00 ml/g or less.

Incidentally, the average pore radius, pore radius and total pore volume are values determined by the BJH (Barrett-Joyner-Halenda) method from an adsorption/desorption isotherm of nitrogen gas obtained from the result of measurement by the nitrogen adsorption/desorption method. In particular, the average pore radius is a value determined by calculation from the total pore volume and a specific surface area measured upon desorption of nitrogen gas. When a recording medium is subjected to the measurement by the nitrogen adsorption/desorption method, the measurement is conducted on other portions than the ink receiving layer. However, the other components (for example, a substrate and a resin coating layer) than the ink receiving layer do not have pores of the size of from 1 nm to 100 nm that is a range generally measurable by the nitrogen adsorption/desorption method. Therefore, when the whole recording medium is subjected to the measurement by the nitrogen adsorption/desorption method, the measurement can be regarded as measurement on the average pore radius in the ink receiving layer.

In order to form an ink receiving layer whose average pore radius is 7.0 nm or more and 10.0 nm or less, it is favorable to use alumina hydrate having a BET specific surface area of 100 $m^2/g$ or more and 200 $m^2/g$ or less. The BET specific surface area is more favorably 125 $m^2/g$ or more and 190 $m^2/g$ or less. The BET method is a method for measuring the surface area of powder by a gas-phase adsorption method, and is a method for determining a total surface area of 1 g of a sample, i.e., a specific surface area, from an adsorption isotherm. In the BET method, nitrogen gas is generally used as an adsorption gas, and a method of measuring an adsorption amount from a change in the pressure or volume of the gas adsorbed is oftenest used. At this time, the Brunauer-Emmett-Teller equation is most marked as that indicating the isotherm of multimolecular adsorption, called the BET equation and widely used in determination of the specific surface area. According to the BET method, the specific surface area is determined by finding an adsorption amount based on the BET equation and multiplying this value by an area occupied by a molecule adsorbed at the surface. In the BET method, the relationship between a certain relative pressure and an absorption amount is determined at several points in the measurement by the nitrogen adsorption/desorption method, and the slope and intercept of plots thereof are found by the least square method to derive the specific surface area. In the present invention, the relationship between the relative pressure and the absorption amount is measured at 5 points to derive the specific surface area.

The alumina hydrate is favorably in the form of a flat plate and has an average aspect ratio of 3.0 or more and 10 or less and a vertical-horizontal ratio of a flat plate surface of 0.60 or more and 1.0 or less. Incidentally, the aspect ratio can be determined according to the method described in Japanese Patent Publication No. H05-16015. More specifically, the aspect ratio is expressed by a ratio of "diameter" to "thickness" of a particle. The term "diameter" as used herein means a diameter (equivalent circle diameter) of a circle having an area equal to a projected area of the particle, which has been obtained by observing the alumina hydrate through a microscope or electron microscope. The vertical-horizontal ratio of the flat plate surface means a ratio of a minimum diameter to a maximum diameter in the flat plate surface when the particle is observed through the microscope in the same manner as in the aspect ratio. If alumina hydrate having an aspect ratio outside the above range is used, the pore distribution range of an ink receiving layer to be formed may become narrow in some cases. It may thus be difficult in some cases to produce alumina hydrate with its particle size uniform. If alumina hydrate having a vertical-horizontal ratio outside the above range is used, the pore distribution range of an ink receiving layer to be formed also becomes narrow likewise.

According to the finding by the present inventors, alumina hydrate having a flat plate form has better dispersibility than that having a needle form even when the alumina hydrates are those of the same kind. The alumina hydrate of the needle form tends to orient in parallel to the surface of the substrate upon coating, and pores to be formed may become small in some cases, and so the ink absorbency of the ink receiving layer may become low. On the other hand, the alumina hydrate of the flat plate form can form good pores in the ink receiving layer.

The content of the alumina hydrate in the ink receiving layer is favorably 30.0% by mass or more and 98.0% by mass or less based on the total mass of the ink receiving layer. Both first ink receiving layer and second ink receiving layer favorably contain the alumina hydrate in an amount of 30.0% by mass or more and 98.0% by mass or less based on the total mass of each layer.

As the alumina pigment used in the present invention, gas-phase-process alumina is mentioned in addition to the alumina hydrate. The ink jet recording medium according to the present invention favorably contains the gas-phase-process alumina as the alumina pigment. In particular, both alumina hydrate and gas-phase-process alumina are favorably contained in the first ink receiving layer because both ink absorbency and conveyance-caused flaw resistance are more improved. The gas-phase-process alumina is favorably that having a specific surface area smaller than that of the alumina hydrate, i.e., that having a large primary particle size. The pore radius of the first ink receiving layer becomes larger than that of the second ink receiving layer by containing the gas-phase-process alumina whose primary particle size is large, so that the ink absorbency is improved. In addition, the conveyance-caused flaw resistance is also improved. Although this mechanism is not clearly known, the present inventors infer it as follows. When particles of a plate-shaped structure such as the alumina hydrate are present in an outermost surface (surface of the first ink receiving layer) of a recording medium, glossiness is somewhat changed due to the deformation of the recording medium and the directional change of the particles present in the outermost surface when the recording medium is pressed by conveying rollers. This glossiness change makes conveyance-caused flaw conspicuous. On the other hand, the gas-phase-process alumina does not have anisotropy because the form thereof is relatively near to a sphere, so that glossiness change is relatively small even when the direction of the particles is changed. This makes conveyance-caused flaw inconspicuous.

The gas-phase-process alumina has a BET specific surface area of favorably 50 $g/m^2$ or more, more favorably $g/m^2$ or more and favorably 150 $g/m^2$ or less, more favorably 120 $g/m^2$ or less. The primary particle size thereof is favorably 5 nm or more, more favorably 11 nm or more and favorably 30 nm or less, more favorably 15 nm or less. Specific examples of the gas-phase-process alumina include AEROXIDE AluC (product of EVONIC Co., primary particle size: 13 nm, BET specific surface area: 100 $g/m^2$), AEROXIDE Alu130 (product of EVONIC Co., primary particle size: 10 nm, BET specific surface area: 130 $g/m^2$) and AEROXIDE Alu65 (product of EVONIC Co., primary particle size: 20 nm, BET specific surface area: 65 $g/m^2$), and these are favorably used. Among these, AEROXIDE AluC and AEROXIDE Alu65 are more favorably used because the ink absorbency and conveyance-caused flaw resistance are improved. In particular, AEROXIDE AluC is furthermore favorable since colorability is also improved.

When the first ink receiving layer contains the gas-phase-process alumina, the first ink receiving layer favorably contains the gas-phase-process alumina in an amount of 10% by mass or more and 70% by mass or less, more favorably 50% by mass or less based on the alumina hydrate. When the gas-phase-process alumina content is 10% by mass or more and 70% by mass or less based on the alumina hydrate, the colorability can be improved in addition to the ink absorbency and conveyance-caused flaw resistance. When the first ink receiving layer contains both alumina hydrate and gas-phase-process alumina, the ratio of the alumina hydrate to the gas-phase-process alumina in the first ink receiving layer is favorably 95:5 to 60:40, more favorably 85:15 to 75:25 in terms of mass ratio.

Polyvinyl Alcohol:

The first and second ink receiving layers contain polyvinyl alcohol. As this polyvinyl alcohol, may be mentioned ordinary polyvinyl alcohol obtained by hydrolyzing polyvinyl acetate. Polyvinyl alcohol having a viscosity-average polymerization degree of 1,500 or more is favorably used, and that having a viscosity-average polymerization degree of 2,000 or more and 5,000 or less is more favorable. The saponification degree thereof is favorably 80% by mol or more, more favorably 85% by mol and 100% by mol or less. As commercially available polyvinyl alcohol, may be mentioned PVA 235 (product of Kuraray Co., Ltd., saponification degree: 88% by mol, average polymerization degree: 3,500,).

Boric Acid:

The first and second ink receiving layers contain boric acid. Examples of boric acid include orthoboric acid ($H_3BO_3$), metaboric acid and hypoboric acid. Among these, orthoboric acid is favorable from the viewpoints of long-term storage stability of a coating liquid for forming the ink receiving layer and an inhibitory effect on the occurrence of cracking.

Contents of Polyvinyl Alcohol and Boric Acid in the Ink Receiving Layer:

The present inventors have found that when the contents of polyvinyl alcohol and boric acid in the two ink receiving layers are controlled to respective specific ranges based on the alumina pigment, these components synergistically act to improve the ink absorbency and conveyance-caused flaw resistance and further improve moisture resistance. Specifically, the first ink receiving layer that is an outermost ink receiving layer contains polyvinyl alcohol in an amount of 7.0% by mass or more and 10.5% by mass or less, favorably 8.5% by mass or more and 10.0% by mass or less, based on the alumina pigment. The amount of polyvinyl alcohol based on the alumina pigment in the first ink receiving layer is particularly favorably 9.5% by mass or more and 10.0% by mass or less. In addition, the first ink receiving layer contains boric acid in an amount of 1.1% by mass or more and 1.4% by mass or less based on the alumina pigment. The second ink receiving layer adjacent to the firs ink receiving layer contains polyvinyl alcohol in an amount of 10.5% by mass or more and 17.0% by mass or less, favorably 11.0% by mass or more and 13.0% by mass or less, based on the alumina pigment. The amount of polyvinyl alcohol based on the alumina pigment in the second ink receiving layer is particularly favorably 11.0% by mass or more and 12.5% by mass or less. In addition, the second ink receiving layer contains boric acid in an amount of 1.5% by mass or more and 2.5% by mass or less based on the alumina pigment. The content is favorably 1.9% by mass or more, more favorably 2.0% by mass or less. In the present invention, the contents of polyvinyl alcohol and boric acid in such two ink receiving layers are important, and these contents are well balanced, whereby the ink absorbency and conveyance-caused flaw resistance, and further moisture resistance can be improved.

The present inventors have further found that the first and second ink receiving layers have a relationship between the respective polyvinyl alcohol content and boric acid content. The polyvinyl alcohol content based on the alumina pigment and the boric acid content based on the alumina pigment in the first ink receiving layer are regarded as P1 and B1, respectively. In addition, the polyvinyl alcohol content based on the alumina pigment and the boric acid content based on the alumina pigment in the second ink receiving layer are regarded as P2 and B2, respectively. At this time, (B2/P2)/(B1/P1) is favorably 1.0 or more and 2.1 or less, more favorably 1.4 or more and 1.9 or less, particularly favorably 1.5 or more and 1.7 or less. This ratio is controlled to 1.0 or more and 2.1 or less, whereby the ink absorbency and conveyance-caused flaw resistance, and further moisture resistance can be improved.

Other Components:

The first and second ink receiving layers may contain other binder(s) than polyvinyl alcohol. Specific examples thereof include the following binders; starch derivatives such as oxidized starch, etherified starch and phosphoric-acid-esterified starch, cellulose derivatives such as carboxymethyl cellulose and hydroxyethyl cellulose, casein, gelatin, soybean protein, polyvinyl pyrrolidone, maleic anhydride resins, latexes of conjugated polymers such as styrene-butadiene copolymers and methyl methacrylate-butadiene copolymers, latexes of acrylic polymers such as acrylic ester and methacrylic ester polymers, latexes of vinyl polymers such as ethylene-vinyl acetate copolymers, functional-group-modified polymer latexes obtained by modifying the above-described polymers with a monomer containing a functional group such as a carboxyl group; cationized polymers obtained by cationizing the above-described polymers with a cationic group, cationized polymers obtained by cationizing the surfaces of the above-described polymers with a cationic surfactant, polymers obtained by polymerizing the above-described polymers under cationic polyvinyl alcohol to distribute polyvinyl alcohol on surfaces of the polymers, polymers obtained by polymerizing the above-described polymers in a suspended dispersion of the cationic colloid particles to distribute cationic colloid particles on surfaces of the polymers, aqueous binders such as thermosetting synthetic resins such as melamine resins and urea resins, polymer or copolymer resins of acrylic esters and methacrylic esters, such as polymethyl methacrylate, and synthetic resin binders such as polyurethane resins, unsaturated polyester resins, vinyl chloride-vinyl acetate copolymers, polyvinyl butyral and alkyd resins.

The first and second ink receiving layers may contain a urethane compound for the purpose of further improving the moisture resistance. The urethane compound is favorably a compound obtained by reacting at least three compounds of a sulfur-containing organic compound (Compound A) having two or more active hydrogen groups, a polyisocyanate compound (Compound B) having two or more isocyanate groups and an amine compound (Compound C) having two or more active hydrogen groups and cationizing at least part of amino groups in the resultant product with an acid. Favorable examples of the urethane compound are shown by the following formulae (1) to (6).

General formula (1)

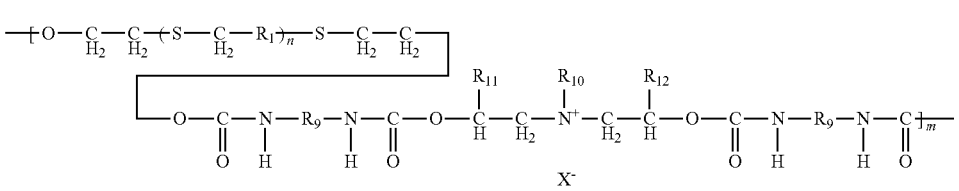

(in the formula, n is 1 or 2, $R_1$ is a methylene, ethylene or propylene group, $R_9$ is an aliphatic hydrocarbon group containing at least one alkylene or heterocycle, $R_{10}$ is an alkyl group having 1 to 4 carbon atoms, $R_{11}$ and $R_{12}$ are, independently of each other, a hydrogen atom or a methyl group, $X^-$ is an acidic negative ion, and m is such a number that the weight average molecular weight of the compound amounts to 2,000 to 150,000.)

General formula (2)

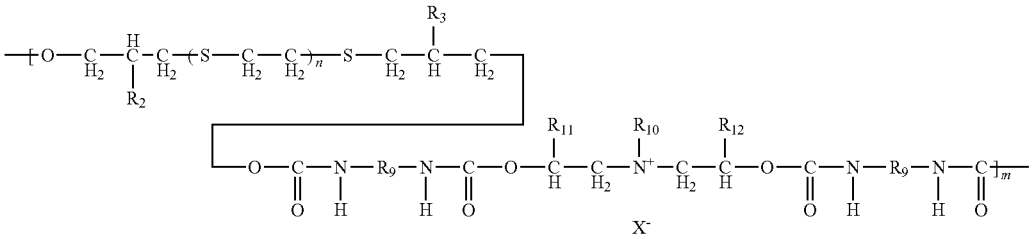

(in the formula, n is 1 or 2, $R_2$ and $R_3$ are, independently of each other, a hydrogen atom, a hydroxyl group or an alkyl group and may be the same or different from each other, and $R_9$ to $R_{12}$, $X^-$ and m have the same meanings as defined in the general formula (1).)

General formula (3)

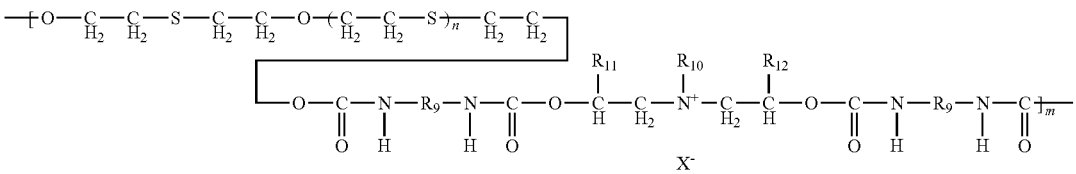

(in the formula, n is 0 or 1, and $R_9$ to $R_{12}$, $X^-$ and m have the same meanings as defined in the general formula (1).)

General formula (4)

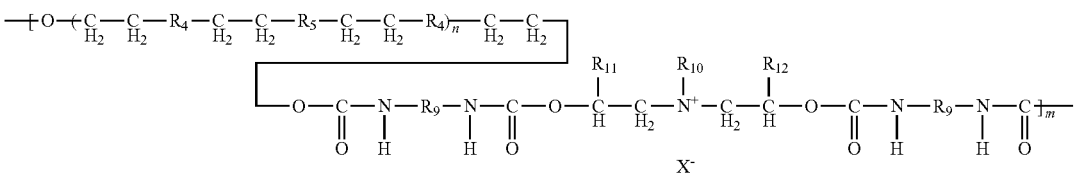

(in the formula, n is 1 or 2, $R_4$ is a sulfur or oxygen atom, $R_5$ is a sulfur atom or —$SO_2$—, with the proviso that $R_4$ and $R_5$ are different from each other, and $R_9$ to $R_{12}$, $X^-$ and m have the same meanings as defined in the general formula (1).)

General formula (5)

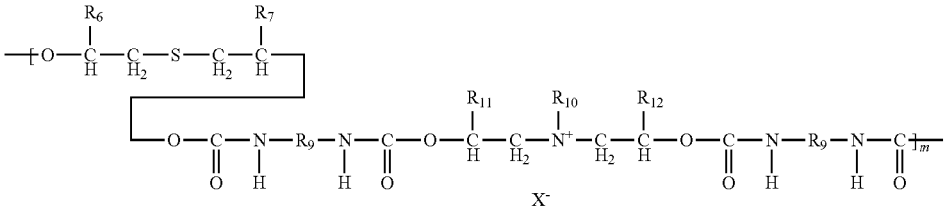

(in the formula, $R_6$ and $R_7$ are, independently of each other, a hydrogen atom or an alkyl group and may be the same or different from each other, and $R_9$ to $R_{12}$, $X^-$ and m have the same meanings as defined in the general formula (1).)

General formula (6)

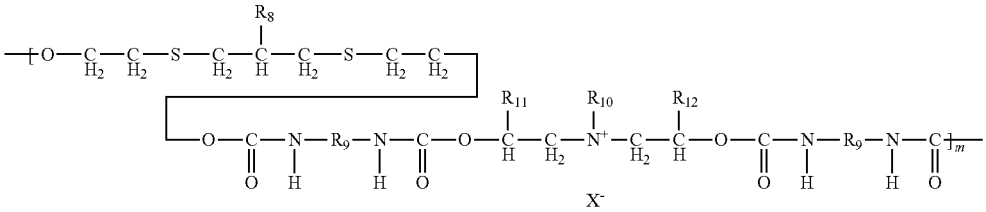

(in the formula, $R_8$ is a hydroxyl group or an alkyl group, and $R_9$ to $R_{12}$, $X^-$ and m have the same meanings as defined in the general formula (1).)

A compound having at least one sulfide group in its molecule is favorable as Compound A. As specific examples thereof, may be mentioned compounds represented by the following general formulae (7) to (12). In particular, the compounds represented by the following general formula (8) or (12) are favorable because such a compound has a high effect to inhibit discoloration and fading of an image caused by acidic gasses in the air or light. Compounds (A) may be used singly or in combination of at least 2 compounds thereof at the same time to synthesize the urethane compound used in the present invention.

General formula (7)

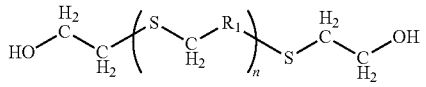

(in the formula, n is 1 or 2, and $R_1$ is a methylene, ethylene or propylene group.)

General formula (8)

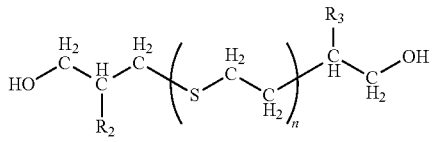

(in the formula, n is 1 or 2, and $R_2$ and $R_3$ are, independently of each other, a hydrogen atom, a hydroxyl group or an alkyl group and may be the same or different from each other.)

General formula (9)

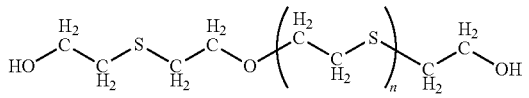

(in the formula, n is 0 or 1.)

General formula (10)

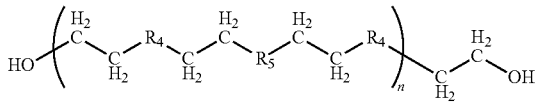

(in the formula, n is 1 or 2, $R_4$ is a sulfur or oxygen atom, and $R_5$ is a sulfur atom or —$SO_2$—, with the proviso that $R_4$ and $R_5$ are different from each other.)

General formula (11)

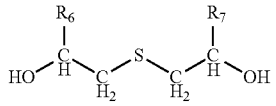

(in the formula, $R_6$ and $R_7$ are, independently of each other, a hydrogen atom or an alkyl group and may be the same or different from each other.)

General formula (12)

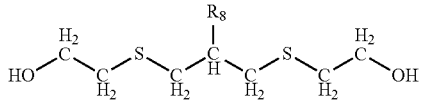

(in the formula, $R_8$ is a hydroxyl or alkyl group.)

Examples of Compound (B) include 2,4-tolylene diisocyanate, 2,6-tolylene diisocyanate, m-phenylene diisocyanate, p-phenylene diisocyanate, 4,4'-diphenyl-methane diisocyanate, 2,4'-diphenylmethane diisocyanate, 2,2'-diphenylmethane diisocyanate, 3,3'-dimethyl-4,4'-biphenylene diisocyanate, 3,3'-dichloro-4,4'-biphenylene diisocyanate, 1,5-naphthalene diisocyanate, 1,5-tetrahydronaphthalene diisocyanate, tetramethylene diisocyanate, 1,6-hexamethylene diisocyanate, dodecamethylene diisocyanate, trimethylhexamethylene diisocyanate, 1,3-cyclohexylene diisocyanate, 1,4-cyclohexylene diisocyanate, xylylene diisocyanate, tetramethylxylylene diisocyanate, hydrogenated xylylene diisocyanate, lysine diisocyanate, isophorone diisocyanate and 4,4'-dicyclohexylmethane diisocyanate. These compounds may be used singly or in combination of at least 2 compounds thereof at the same time to synthesize the urethane compound used in the present invention.

Such a tertiary amine as represented by the following general formula (13) is favorable as Compound (C).

General formula (13)

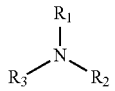

(in the formula, any one of $R_1$, $R_2$ and $R_3$ is an alkyl, alkanol or aminoalkyl group having 1 to 6 carbon atoms, and the other groups may be the same or different from each other and are individually an alkanol, aminoalkyl or alkanethiol group.)

Examples of Compound C represented by the general formula (13) include diol compounds such as N-methyl-N,N-diethanolamine, N-ethyl-N,N-diethanolamine, N-isobutyl-N,N-diethanolamine, N-t-butyl-N,N-diethanolamine and N-t-butyl-N,N-diisopropanolamine; triol compounds such as triethanolamine; diamine compounds such as methyliminobispropylamine and butyliminobispropylamine; and triamine compounds such as tri(2-aminoethyl)amine. These amine compounds may be used singly or in combination of at least 2 compounds thereof at the same time to synthesize the urethane compound.

The weight-average molecular weight of the urethane compound is favorably 2,000 or more and 150,000 or less, more preferably 2,000 or more and 50,000 or less. If the weight-average molecular weight of the urethane compound is less than 2,000, the glossiness of the resulting ink-receiving layer and the printing density may be lowered in some cases. If the weight-average molecular weight exceeds 150,000, the reaction time required for obtaining such a urethane compound may become long in some cases to increase synthesis cost.

In the synthesis of the urethane compound, any other compound (hereinafter referred to as "Compound D") having two or more active hydrogen groups than the above-described Compound A and Compound C may be copolymerized as needed. Examples of such a compound include polyester polyols, polyether polyols and polycarbonate polyols.

The urethane compound may be stably dispersed or dissolved in water by cationizing at least a part of the Compound C unit with an acid. When the cationization is conducted with a cationizing agent such as an alkyl halide as another method, such a cationized urethane compound cannot be stably dispersed or dissolved with a favorable particle size in water. When, for example, a polyvalent acid is used as the acid, viscosity increase may be caused in some cases when such a cationized urethane compound is dispersed or dissolved in water. Therefore, phosphoric acid and/or a monovalent acid is favorably used.

When the urethane compound is dispersed in an aqueous medium, the average particle size of the resulting dispersion is favorably 5 nm or more and 500 nm or less, more favorably 50 nm or more and 200 nm or less from the viewpoint of storage stability. Incidentally, the average particle size of the urethane compound is measured by The average particle size defined in the present invention can be easily measured by means of, for example, a particle size measuring device (ELSZ, manufactured by OTSUKA ELECTRONICS Co., Ltd.) according to the dynamic light scattering method. The urethane compound used in the present invention favorably has a glass transition temperature (Tg) of 50° C. or more and 80° C. or less.

In the present invention, only the first ink receiving layer of the first and second ink receiving layers favorably contains the urethane compound. Only the first ink receiving layer contains the urethane compound, whereby the urethane compound can act synergistically with the layer structure of the present invention to achieve good ink absorbency. The first ink receiving layer favorably contains the urethane compound in an amount of 1% by mass or more and 6% by mass or less based on the alumina pigment. If the content is less than 1% by mass, the moisture resistance may not be sufficiently improved in some cases. If the content is more than 6% by mass, the colorability man be lowered in some cases. The urethane compound is more favorably contained in an amount of 2% by mass or more and 4% by mass or less.

The first and second ink receiving layers are formed by applying respective coating liquids for forming the ink-receiving layers on to the substrate. These coating liquids contain an aqueous alumina dispersion, and the alumina pigment is favorably well dispersed in the aqueous alumina dispersion. Therefore, the aqueous alumina dispersion favorably contains, as a deflocculant, an alkylsulfonic acid having 1 to 4 carbon atoms. As a result, the ink receiving layers come to contain the alkylsulfonic acid having 1 to 4 carbon atoms. When an alkylsulfonic acid having 5 or more carbon atoms or a sulfonic acid having a benzene ring is used as the deflocculant, color stability and moisture resistance are lowered, and an image density is liable to be lowered. The reason for this is considered as follows. When the number of carbon atoms increases, the hydrophobicity of the deflocculant becomes strong, and consequently the hydrophobicity on the surface of the alumina pigment becomes strong, so that the dye fixing rate on the surface of the alumina pigment slows. When the alumina pigment is deflocculated with the alkylsulfonic acid having 5 or more carbon atoms or the sulfonic acid having a benzene ring, it is difficult to achieve sufficient dispersion stability, and viscosity increase is liable to proceed. In addition, the alumina may be aggregated in some cases to cause lowering of the image density. The alkylsulfonic acid having 1 to 4 carbon atoms is favorably a monobasic acid having only a sulfonic group as a solubilizing group. The alkyl group is favorably an alkyl group having no solubilizing group such as a hydroxyl group or a carboxyl group from the viewpoint of moisture resistance. The alkylsulfonic acid is favorably a monobasic acid having a non-substituted alkyl chain having 1 to 4 carbon atoms. The alkyl chain may be either linear or branched. Favorable examples of the alkylsulfonic acid include methanesulfonic acid, ethanesulfonic acid, isopropanesulfonic acid, n-propane-sulfonic acid, n-butanesulfonic acid, isobutanesulfonic acid and t-butanesulfonic acid. Among these, methanesulfonic acid, ethanesulfonic acid, isopropane-sulfonic acid and n-propanesulfonic acid are favorable. Incidentally, the alkylsulfonic acids having 1 to 4 carbon atoms may be used in combination of 2 or more thereof. Methanesulfonic acid is most favorable.

The first and second ink receiving layers favorably contain the alkylsulfonic acid having 1 to 4 carbon atoms in an amount of 1.0% by mass or more and 2.0% by mass or less based on the alumina pigment. The content is 1.0% by mass or more, whereby moisture resistance and ozone resistance are improved. The content is 2.0% by mass or less, whereby ink absorbency is improved. The content is more favorably 1.3% by mass or more and 1.6% by mass or less.

The first and second ink receiving layers may contain the following additives such as, for example, pH adjustors, pigment dispersants, thickeners, flowability modifiers, antifoaming agents, foam inhibitors, surfactants, parting agents, penetrants, coloring pigments, coloring dyes, fluorescent whitening agents, ultraviolet absorbents, antioxidants, preservatives, mildew-proofing agents, water-proofing agents, dye-fixing agents, hardeners and weathering materials.

Coating Liquids for Forming the Respective Ink Receiving Layers:

The coating process of coating liquids for forming the respective ink receiving layers is favorably conducted by using, for example, various curtain coaters, a coater using an extrusion system or a coater using a slide hopper system. Upon the coating of each coating liquid, the coating liquid may also be heated for the purpose of adjusting the viscosity of the coating liquid. Alternatively, a coater head may also be heated. For example, a hot air dryer such as a linear tunnel dryer, arch dryer, air loop dryer or sine curve air float dryer may be used for drying of the coating liquid after the coating. An infrared heating dryer or a dryer utilizing microwaves may also be used.

The film thickness of the ink receiving layer is greatly affected by the coating amount of the coating liquid for forming the ink receiving layer. The film thickness of the first ink receiving layer is favorably controlled to 3 μm or more and 18 μm or less. If the film thickness is thinner than 3 μm, the thickness of the layer containing small amounts of polyvinyl alcohol and boric acid becomes thin, so that the ink absorbency may be lowered in some cases. If the film thickness exceeds 18 μm, the thickness of the layer containing small amounts of polyvinyl alcohol and boric acid becomes thick, so that the conveyance-caused flaw resistance may be lowered in some cases. The film thickness of the first ink receiving layer is more favorably 6.5 μm or more and 18.0 μm or less, particularly favorably 9.0 μm or more and 13.0 μm or less. The film thickness of the second ink receiving layer is favorably controlled to 17 μm or more and 35 μm or less. If the film thickness is thinner than 17 μm, the thickness of the layer containing large amounts of polyvinyl alcohol and boric acid becomes thin, so that the conveyance-caused flaw resistance may be lowered in some cases. If the film thickness exceeds 35 μm, the total film thickness becomes thick, so that the productivity may be lowered in some cases. The film thickness of the second ink receiving layer is more favorably controlled to 25.0 μm or more and 35.0 μm or less, particularly favorably 27.0 μm or more and 33.0 μm or less.

The film thickness of the whole ink receiving layer is favorably controlled to 35 μm or more and 45 μm or less. If the film thickness is thinner than 35 μm, there is a tendency for the ink absorbency to be lowered. If the film thickness exceeds 45 μm, there is a tendency for the conveyance-caused flaw resistance to be lowered. The film thickness is more favorably 40 μm or less. With respect to the relationship in film thickness between the first and second ink receiving layers, (the film thickness of the first ink receiving layer)/(the film thickness of the second ink receiving layer) is favorably 0.09 or more and 1.10 or less, more favorably 0.16 or more and 0.75 or less.

Incidentally, the film thickness in the present invention means a film thickness measured upon being absolutely dried and is an average value of measured values obtained by measuring the section of an object to be measured at 4 points through a scanning electron microscope. In the present invention, the object whose film thickness to be measured is set in a quadrangular shape, and the positions 1 cm distant from the 4 corners of the object in a direction of the center of gravity of the quadrangle are taken to be the 4 points.

In the present invention, a thin layer may be provided on the first ink receiving layer that is an outermost ink receiving layer or between the first ink receiving layer and the second ink receiving layer within limits not impeding the effects of the present invention. In short, in the present invention, the outermost ink receiving layer may form an outermost surface of the recording medium, or the thin layer provided on the outermost ink receiving layer may form the outermost surface of the recording medium. In this case, the film thickness of the thin layer is favorably controlled to 2.0 μm or less. In addition, an ink receiving layer may also be provided between the second ink receiving layer and the substrate.

In particular, the thin layer provided on the first ink receiving layer is favorably a layer containing gas-phase-process silica. The layer containing gas-phase-process silica is provided, whereby the conveyance-caused flaw resistance is more improved. AEROSIL 300 (product of EVONIC Co.) is favorable as the gas-phase-process silica. In addition, the thin layer favorably contains polyvinyl alcohol together with the gas-phase-process silica. The content of polyvinyl alcohol is favorably 10 parts by mass or more and 25 parts by mass or less per 100 parts by mass of the gas-phase-process silica. The thin layer provided on the first ink receiving layer favorably contains boric acid. The content of boric acid is favorably 1 part by mass or more and 10 parts by mass or less per 100 parts by mass of the gas-phase-process silica. Although the film thickness of the thin layer provided on the first ink receiving layer is favorably controlled to 2.0 μm or less, the film thickness is favorably controlled to at least 0.1 μm or more. The film thickness is controlled to 0.1 μm or more, whereby the conveyance-caused flaw resistance is improved. If the film thickness exceeds 2.0 μm, such a thin film comes to have the same function as the ink receiving layer, so that it is difficult to achieve the effects of the present invention. The film thickness is more favorably 0.5 μm or less.

EXAMPLES

The present invention will hereinafter be described more specifically by the following Examples and Comparative Examples. However, the scope of the present invention are not limited to these examples.

Preparation of Substrate:

A substrate was prepared under the following conditions. A paper stock of the following composition was first adjusted with water so as to give a solid content concentration of 3.0% by mass.

| | |
|---|---|
| Laubsholz bleached kraft pulp (LBKP) having a freeness of 450 ml CSF (Canadian Standard Freeness) | 80.00 parts by mass |
| Nadelholz bleached kraft pulp (NBKP) having a freeness of 480 ml CSF | 20.00 parts by mass |
| Cationized starch | 0.60 parts by mass |
| Ground calcium carbonate | 10.00 parts by mass |
| Precipitated calcium carbonate | 15.00 parts by mass |
| Alkyl ketene dimer | 0.10 parts by mass |
| Cationic polyacrylamide | 0.03 parts by mass. |

Paper was made from the resultant paper stock by a Fourdrinier paper machine, subjected to 3-stage wet pressing and then dried by a multi-cylinder dryer. The resultant paper was then impregnated with an aqueous solution of oxidized starch by a size pressing device so as to give a solid content of 1.0 g/m$^2$, and dried. The paper was further finished by a machine calendar to prepare base paper having a basis weight of 170 g/m$^2$, a Stöckigt sizing degree of 100 seconds, a gas permeability of 50 seconds, a Bekk smoothness of 30 seconds and a Gurley stiffness of 11.0 mN.

A resin composition composed of low density polyethylene (70 parts by mass), high density polyethylene (20 parts by mass) and titanium oxide (10 parts by mass) was applied in an amount of 25 g/m$^2$ on to one surface of the base paper to regard this surface as a front surface. A resin composition composed of high density polyethylene (50 parts by mass) and low density polyethylene (50 parts by mass) was further applied in an amount of 25 g/m$^2$ on to a surface (back surface) opposite to the front surface, thereby preparing a resin-coated substrate.

Preparation of Alumina Pigment Dispersion:

Alumina Hydrate Dispersion 1

With 160.0 g of pure water, were mixed 40.0 g of alumina hydrate 1 (Disperal HP14, product of Sasol Co.) and 0.6 g (1.5% by mass based on the alumina hydrate content) of methanesulfonic acid. After the mixing, the resultant mixture was stirred for 30 minutes by a mixer to prepare an aqueous alumina hydrate dispersion 1. After 30 minutes, it was visually confirmed that the dispersed state of the alumina hydrate was good. The solid content concentration of the alumina hydrate dispersion 1 was measured and found to be 20.0% by mass. The measurement of the solid content concentration was conducted by weighing 5.0 g of the alumina hydrate dispersion and using an infrared moisture meter FD-620 (manufactured by KETT ELECTRIC LABORATORY) at 120° C. The average particle size of the alumina hydrate in the dispersion was measured by a particle size measuring device (ELSZ, manufactured by OTSUKA ELECTRONICS Co., Ltd.) according to the dynamic light scattering method and found to be 130 nm.

Gas-Phase-Process Alumina Dispersion 1

With 160.0 g of pure water, were mixed 40.0 g of gas-phase-process alumina 1 (AEROXIDE AluC, product of EVONIC Co.) and 0.5 g (1.3% by mass based on the gas-phase-process alumina content) of methanesulfonic acid. After the mixing, the resultant mixture was stirred for 30 minutes by a mixer to prepare a gas-phase-process alumina dispersion 1. After 30 minutes, it was visually confirmed that the dispersed state of the gas-phase-process alumina was good. The solid content concentration of the gas-phase-process alumina dispersion 1 was measured and found to be 20.0% by mass. The measurement of the solid content concentration was conducted by weighing 5.0 g of the gas-phase-process alumina dispersion and using an infrared moisture meter FD-620 (manufactured by KETT ELECTRIC LABO- RATORY) at 120° C. The average particle size of the gas-phase-process alumina in the dispersion was measured by a particle size measuring device (ELSZ, manufactured by OTSUKA ELECTRONICS Co., Ltd.) according to the dynamic light scattering method and found to be 160 nm.

Gas-Phase-Process Alumina Dispersion 2

With 160.0 g of pure water, were mixed 40.0 g of gas-phase-process alumina 2 (AEROXIDE Alu65, product of EVONIC Co.) and 0.5 g (1.3% by mass based on the gas-phase-process alumina content) of methanesulfonic acid. After the mixing, the resultant mixture was stirred for 30 minutes by a mixer to prepare a gas-phase-process alumina dispersion 2. After 30 minutes, it was visually confirmed that the dispersed state of the gas-phase-process alumina was good. The solid content concentration of the gas-phase-process alumina dispersion 2 was measured and found to be 20.0% by mass. The measurement of the solid content concentration was conducted by weighing 5.0 g of the gas-phase-process alumina dispersion and using an infrared moisture meter FD-620 (manufactured by KETT ELECTRIC LABORATORY) at 120° C. The average particle size of the gas-phase-process alumina in the dispersion was measured by a particle size measuring device (ELSZ, manufactured by OTSUKA ELECTRONICS Co., Ltd.) according to the dynamic light scattering method and found to be 180 nm.

Gas-Phase-Process Alumina Dispersion 3

With 160.0 g of pure water, were mixed 40.0 g of gas-phase-process alumina 3 (AEROXIDE Alu130, product of EVONIC Co.) and 0.5 g (1.3% by mass based on the gas-phase-process alumina content) of methanesulfonic acid. After the mixing, the resultant mixture was stirred for 30 minutes by a mixer to prepare a gas-phase-process alumina dispersion 3. After 30 minutes, it was visually confirmed that the dispersed state of the gas-phase-process alumina was good. The solid content concentration of the gas-phase-process alumina dispersion 3 was measured and found to be 20.0% by mass. The measurement of the solid content concentration was conducted by weighing 5.0 g of the gas-phase-process alumina dispersion and using an infrared moisture meter FD-620 (manufactured by KETT ELECTRIC LABORATORY) at 120° C. The average particle size of the gas-phase-process alumina in the dispersion was measured by a particle size measuring device (ELSZ, manufactured by OTSUKA ELECTRONICS Co., Ltd.) according to the dynamic light scattering method and found to be 150 nm.

Gas-Phase-Process Silica Dispersion 1

With 168.0 g of pure water, were mixed 40.0 g of gas-phase-process silica (AEROSIL 300, product of EVONIC Co.) and 4.0 g (5% by mass based on the gas-phase-process silica content) of an aqueous solution of a cationic polymer (SHALLOL DC-902P, 50% by mass aqueous solution, product of DAI-ICHI KOGYO SEIYAKU CO., LTD.). After the mixing, the resultant mixture was stirred for 30 minutes by a mixer to prepare a gas-phase-process silica dispersion 1. After 30 minutes, it was visually confirmed that the dispersed state of the gas-phase-process silica was good. The solid content concentration of the gas-phase-process silica dispersion 1 was measured and found to be 20.0% by mass. The measurement of the solid content concentration was conducted by weighing 5.0 g of the gas-phase-process silica dispersion and using an infrared moisture meter FD-620 (manufactured by KETT ELECTRIC LABORATORY) at 120° C. The average particle size of the gas-phase-process silica in the dispersion was measured by a particle size measuring device (ELSZ, manufactured by OTSUKA ELECTRONICS Co., Ltd.) according to the dynamic light scattering method and found to be 130 nm.

Aqueous Polyvinyl Alcohol Solution 1

Under room temperature, 50.0 g of polyvinyl alcohol (PVA 235, product of Kuraray Co., Ltd.; polymerization degree: 3,500, saponification degree: 88%) was mixed with 505.0 g of pure water. After 10 minutes, the resultant mixture was heated to 90° C. and stirred additionally for 30 minutes to dissolve polyvinyl alcohol, and the resultant solution was then air-cooled to room temperature (25° C.) to obtain an aqueous polyvinyl alcohol solution 1. The solid content concentration of the aqueous polyvinyl alcohol solution 1 was measured and found to be 9.0% by mass. The measurement of the solid content concentration was conducted by weighing 5.0 g of the aqueous polyvinyl alcohol solution and using an infrared moisture meter FD-620 (manufactured by KETT ELECTRIC LABORATORY) at 120° C.

Synthesis of Urethane Compound 1

A reaction vessel equipped with a stirrer, a thermometer and a reflux condenser was charged with 140 g of acetone as a reaction solvent. While stirring the contents, 50.00 g of 3,6-dithia-1,8-octanediol and 10.46 g of methyldiethanolamine were dissolved therein. After the dissolution, the resultant solution was heated to 40° C., and 79.66 g of isophorone diisocyanate was added. Thereafter, the resultant mixture was heated to 50° C., 0.4 g of a tin catalyst was added, and the mixture was heated further to 55° C. to conduct a reaction for 4 hours with stirring.

After completion of the reaction, the reaction solution was cooled to room temperature, and 9.14 g of 35% hydrochloric acid was added to cationize the polymer. After 573 g of water was additionally added, the resultant mixture was concentrated under reduced pressure to remove acetone, and the concentration of the mixture was adjusted with water, thereby synthesizing an aqueous dispersion of a urethane compound 1 having a solid content of 20% by mass. The average particle size of the urethane compound 1 was measured by a particle size measuring device (ELSZ, manufactured by OTSUKA ELECTRONICS Co., Ltd.) according to the dynamic light scattering method and found to be 35 nm. The glass transition temperature (Tg) thereof was measured and found to be 60° C.

Example 1

The above-described substrate was subjected to simultaneous 2-layer coating with coating liquids 1 and 2 for forming an ink receiving layer, which were prepared according to the following respective compositions, by a curtain coater. An aqueous boric acid solution in the following compositions is an aqueous solution obtained by adding boric acid into pure water. The coating was conducted in such a manner that the coating liquid 2 for forming the ink receiving layer is located on the side of the substrate. After the coating, air of 60 to 100° C. was successively applied to dry the substrate. In this manner, an ink jet recording medium 1 was prepared. Incidentally, the ink receiving layer formed by the coating liquid 1 for forming the ink receiving layer is a first ink receiving layer that is an outermost layer, and the ink receiving layer formed by the coating liquid 2 for forming the ink receiving layer is a second ink receiving layer adjacent to the first ink receiving layer.

| Coating liquid 1 for forming ink receiving layer: | |
|---|---|
| Alumina hydrate dispersion 1 (20.0% by mass dispersion) | 100.0 parts by mass |

-continued

| Coating liquid 1 for forming ink receiving layer: | |
|---|---|
| Aqueous polyvinyl alcohol solution 1 (9.0% by mass aqueous solution) | 15.6 parts by mass |
| Aqueous boric acid solution (5.0% by mass aqueous solution) | 4.4 parts by mass. |

| Coating liquid 2 for forming ink receiving layer: | |
|---|---|
| Alumina hydrate dispersion 1 (20.0% by mass dispersion) | 100.0 parts by mass |
| Aqueous polyvinyl alcohol solution 1 (9.0% by mass aqueous solution) | 24.4 parts by mass |
| Aqueous boric acid solution (5.0% by mass aqueous solution) | 6.0 parts by mass. |

The compositions of the first and second ink receiving layers are shown in Table 1. The parts by mass shown in Table 1 are solid contents. The composition of the first ink receiving layer is the alumina pigment (alumina hydrate 1)/polyvinyl alcohol/boric acid=100/7.0/1.1 in terms of mass ratio. The composition of the second ink receiving layer is the alumina pigment (alumina hydrate 1)/polyvinyl alcohol/boric acid=100/11.0/1.5 in terms of mass ratio.

A sample for observing the sections of the ink receiving layers of the ink jet recording medium 1 was prepared by a microtome to measure the film thicknesses of the ink receiving layers by an optical microscope. As a result, the film thickness of the first ink receiving layer was 10 μm, and the film thickness of the second ink receiving layer was 25 μm.

Examples 2 to 41 and Comparative Examples 1 to 8

Ink jet recording media 2 to 41, and 46 to 53 were prepared according to their corresponding compositions shown in Tables 1 and 2 according to Example 1.

Examples 42 and 43

In Examples 42 and 43, the first ink receiving layer of the ink jet recording medium 1 was coated with a coating liquid of the following composition by a gravure coater to form a thin layer. The coating amount of the coating liquid was adjusted to control the film thickness of the coating layer after drying to 0.1 μm in Example 42 and 2.0 μm in Example 43. In this manner, ink jet recording media 42 and 43 shown in Table 1 were prepared.

| Composition of thin layer: | |
|---|---|
| Gas-phase-process silica dispersion 1 (20.0% by mass aqueous dispersion) | 100 parts by mass |
| Aqueous polyvinyl alcohol solution 1 (9.0% by mass aqueous solution) | 45 parts by mass |
| Aqueous boric acid solution (5.0% by mass aqueous solution) | 16 parts by mass. |

Examples 44 and 45

In Examples 44 and 45, the urethane compound 1 was added into the first ink receiving layer of the ink jet recording medium 1. The amount of the urethane compound 1 was controlled to 1% by mass based on the alumina hydrate 1 in Example 44 and 6% by mass based on the alumina hydrate 1 in Example 45. In this manner, ink jet recording media 44 and 45 shown in Table 1 were prepared.

TABLE 1

| | | Second ink receiving layer | | | | | First ink receiving layer | | |
|---|---|---|---|---|---|---|---|---|---|
| | Recording medium | Film thickness μm | Alumina hydrate 1 parts by mass | Polyvinyl alcohol parts by mass | Boric acid parts by mass | B2/P2 | Film thickness μm | Alumina hydrate 1 parts by mass | Gas-phase-alumina 1 parts by mass |
| Ex. 1 | 1 | 25.0 | 100 | 11.0 | 1.5 | 14% | 10.0 | 100 | 0 |
| Ex. 2 | 2 | 25.0 | 100 | 11.0 | 1.5 | 14% | 10.0 | 100 | 0 |
| Ex. 3 | 3 | 25.0 | 100 | 11.0 | 1.5 | 14% | 10.0 | 100 | 0 |
| Ex. 4 | 4 | 25.0 | 100 | 11.0 | 1.5 | 14% | 10.0 | 100 | 0 |
| Ex. 5 | 5 | 25.0 | 100 | 11.0 | 1.5 | 14% | 10.0 | 100 | 0 |
| Ex. 6 | 6 | 25.0 | 100 | 13.0 | 1.5 | 12% | 10.0 | 100 | 0 |
| Ex. 7 | 7 | 25.0 | 100 | 15.0 | 1.5 | 10% | 10.0 | 100 | 0 |
| Ex. 8 | 8 | 25.0 | 100 | 17.0 | 1.5 | 9% | 10.0 | 100 | 0 |
| Ex. 9 | 9 | 25.0 | 100 | 11.0 | 1.8 | 16% | 10.0 | 100 | 0 |
| Ex. 10 | 10 | 25.0 | 100 | 11.0 | 2.2 | 20% | 10.0 | 100 | 0 |
| Ex. 11 | 11 | 25.0 | 100 | 11.0 | 2.5 | 23% | 10.0 | 100 | 0 |
| Ex. 12 | 12 | 25.0 | 100 | 11.0 | 1.5 | 14% | 10.0 | 100 | 0 |
| Ex. 13 | 13 | 25.0 | 100 | 11.0 | 2.5 | 23% | 10.0 | 100 | 0 |
| Ex. 14 | 14 | 25.0 | 100 | 17.0 | 1.5 | 9% | 10.0 | 100 | 0 |
| Ex. 15 | 15 | 25.0 | 100 | 17.0 | 2.5 | 15% | 10.0 | 100 | 0 |
| Ex. 16 | 16 | 25.0 | 100 | 17.0 | 2.5 | 15% | 10.0 | 100 | 0 |
| Ex. 17 | 17 | 25.0 | 100 | 11.0 | 2.5 | 23% | 10.0 | 100 | 0 |
| Ex. 18 | 18 | 25.0 | 100 | 17.0 | 1.5 | 9% | 10.0 | 100 | 0 |
| Ex. 19 | 19 | 25.0 | 100 | 17.0 | 1.5 | 9% | 10.0 | 100 | 0 |
| Ex. 20 | 20 | 25.0 | 100 | 17.0 | 2.5 | 15% | 10.0 | 100 | 0 |
| Ex. 21 | 21 | 25.0 | 100 | 17.0 | 2.5 | 15% | 10.0 | 100 | 0 |
| Ex. 22 | 22 | 25.0 | 100 | 11.0 | 1.8 | 16% | 10.0 | 100 | 0 |
| Ex. 23 | 23 | 25.0 | 100 | 11.0 | 2.0 | 18% | 10.0 | 100 | 0 |
| Ex. 24 | 24 | 25.0 | 100 | 11.0 | 2.3 | 21% | 10.0 | 100 | 0 |
| Ex. 25 | 25 | 25.0 | 100 | 11.0 | 2.5 | 23% | 10.0 | 100 | 0 |
| Ex. 26 | 26 | 17.0 | 100 | 17.0 | 2.5 | 15% | 18.0 | 100 | 0 |
| Ex. 27 | 27 | 20.0 | 100 | 17.0 | 2.5 | 15% | 15.0 | 100 | 0 |

TABLE 1-continued

| | | | | | | | | | |
|---|---|---|---|---|---|---|---|---|---|
| Ex. 28 | 28 | 27.0 | 100 | 17.0 | 2.5 | 15% | 8.0 | 100 | 0 |
| Ex. 29 | 29 | 30.0 | 100 | 17.0 | 2.5 | 15% | 5.0 | 100 | 0 |
| Ex. 30 | 30 | 32.0 | 100 | 17.0 | 2.5 | 15% | 3.0 | 100 | 0 |
| Ex. 31 | 31 | 25.0 | 100 | 11.0 | 2.5 | 23% | 10.0 | 90 | 10 |
| Ex. 32 | 32 | 25.0 | 100 | 11.0 | 2.5 | 23% | 10.0 | 80 | 20 |
| Ex. 33 | 33 | 25.0 | 100 | 11.0 | 2.5 | 23% | 10.0 | 70 | 30 |
| Ex. 34 | 34 | 25.0 | 100 | 11.0 | 2.5 | 23% | 10.0 | 60 | 40 |
| Ex. 35 | 35 | 25.0 | 100 | 11.0 | 2.5 | 23% | 10.0 | 90 | 0 |
| Ex. 36 | 36 | 25.0 | 100 | 11.0 | 2.5 | 23% | 10.0 | 90 | 0 |
| Ex. 37 | 37 | 25.0 | 100 | 11.0 | 2.5 | 23% | 10.0 | 80 | 0 |
| Ex. 38 | 38 | 25.0 | 100 | 11.0 | 2.5 | 23% | 10.0 | 70 | 0 |
| Ex. 39 | 39 | 27.5 | 100 | 11.0 | 2.5 | 23% | 10.0 | 80 | 20 |
| Ex. 40 | 40 | 30.0 | 100 | 11.0 | 2.5 | 23% | 10.0 | 80 | 20 |
| Ex. 41 | 41 | 35.0 | 100 | 11.0 | 2.5 | 23% | 10.0 | 80 | 20 |
| Ex. 42 | 42 | 25.0 | 100 | 11.0 | 1.5 | 14% | 10.0 | 100 | 0 |
| Ex. 43 | 43 | 25.0 | 100 | 11.0 | 1.5 | 14% | 10.0 | 100 | 0 |
| Ex. 44 | 44 | 25.0 | 100 | 11.0 | 1.5 | 14% | 10.0 | 100 | 0 |
| Ex. 45 | 45 | 25.0 | 100 | 11.0 | 1.5 | 14% | 10.0 | 100 | 0 |

| | First ink receiving layer | | | | | | |
|---|---|---|---|---|---|---|---|
| | Gas-phase-alumina 2 parts by mass | Gas-phase-alumina 3 parts by mass | Polyvinyl alcohol parts by mass | Boric acid parts by mass | B1/P1 | Total film thickness μm | (B2/P2)/(B1/P1) |
| Ex. 1 | 0 | 0 | 7.0 | 1.1 | 16% | 35.0 | 0.9 |
| Ex. 2 | 0 | 0 | 8.5 | 1.1 | 13% | 35.0 | 1.1 |
| Ex. 3 | 0 | 0 | 10.0 | 1.1 | 11% | 35.0 | 1.2 |
| Ex. 4 | 0 | 0 | 8.5 | 1.2 | 14% | 35.0 | 1.0 |
| Ex. 5 | 0 | 0 | 8.5 | 1.4 | 16 & | 35.0 | 0.8 |
| Ex. 6 | 0 | 0 | 8.5 | 1.2 | 14% | 35.0 | 0.8 |
| Ex. 7 | 0 | 0 | 8.5 | 1.2 | 14% | 35.0 | 0.7 |
| Ex. 8 | 0 | 0 | 8.5 | 1.2 | 14% | 35.0 | 0.6 |
| Ex. 9 | 0 | 0 | 8.5 | 1.2 | 14% | 35.0 | 1.2 |
| Ex. 10 | 0 | 0 | 8.5 | 1.2 | 14% | 35.0 | 1.4 |
| Ex. 11 | 0 | 0 | 8.5 | 1.2 | 14% | 35.0 | 1.6 |
| Ex. 12 | 0 | 0 | 10.0 | 1.4 | 14% | 35.0 | 1.0 |
| Ex. 13 | 0 | 0 | 10.0 | 1.4 | 14% | 35.0 | 1.6 |
| Ex. 14 | 0 | 0 | 10.0 | 1.4 | 14% | 35.0 | 0.6 |
| Ex. 15 | 0 | 0 | 10.0 | 1.4 | 14% | 35.0 | 1.1 |
| Ex. 16 | 0 | 0 | 7.0 | 1.1 | 16% | 35.0 | 0.9 |
| Ex. 17 | 0 | 0 | 7.0 | 1.4 | 20% | 35.0 | 1.1 |
| Ex. 18 | 0 | 0 | 7.0 | 1.4 | 20% | 35.0 | 0.4 |
| Ex. 19 | 0 | 0 | 10.0 | 1.1 | 11% | 35.0 | 0.8 |
| Ex. 20 | 0 | 0 | 7.0 | 1.4 | 20% | 35.0 | 0.7 |
| Ex. 21 | 0 | 0 | 10.0 | 1.1 | 11% | 35.0 | 1.3 |
| Ex. 22 | 0 | 0 | 10.0 | 1.1 | 11% | 35.0 | 1.5 |
| Ex. 23 | 0 | 0 | 10.0 | 1.1 | 11% | 35.0 | 1.7 |
| Ex. 24 | 0 | 0 | 10.0 | 1.1 | 11% | 35.0 | 1.9 |
| Ex. 25 | 0 | 0 | 10.0 | 1.1 | 11% | 35.0 | 2.1 |
| Ex. 26 | 0 | 0 | 10.0 | 1.1 | 11% | 35.0 | 1.3 |
| Ex. 27 | 0 | 0 | 10.0 | 1.1 | 11% | 35.0 | 1.3 |
| Ex. 28 | 0 | 0 | 10.0 | 1.1 | 11% | 35.0 | 1.3 |
| Ex. 29 | 0 | 0 | 10.0 | 1.1 | 11% | 35.0 | 1.3 |
| Ex. 30 | 0 | 0 | 10.0 | 1.1 | 11% | 35.0 | 1.3 |
| Ex. 31 | 0 | 0 | 10.0 | 1.4 | 14% | 35.0 | 1.6 |
| Ex. 32 | 0 | 0 | 10.0 | 1.4 | 14% | 35.0 | 1.6 |
| Ex. 33 | 0 | 0 | 10.0 | 1.4 | 14% | 35.0 | 1.6 |
| Ex. 34 | 0 | 0 | 10.0 | 1.4 | 14% | 35.0 | 1.6 |
| Ex. 35 | 10 | 0 | 10.0 | 1.4 | 14% | 35.0 | 1.6 |
| Ex. 36 | 0 | 10 | 10.0 | 1.4 | 14% | 35.0 | 1.6 |
| Ex. 37 | 0 | 20 | 10.0 | 1.4 | 14% | 35.0 | 1.6 |
| Ex. 38 | 0 | 30 | 10.0 | 1.4 | 14% | 35.0 | 1.6 |
| Ex. 39 | 0 | 0 | 10.0 | 1.4 | 14% | 37.5 | 1.6 |
| Ex. 40 | 0 | 0 | 10.0 | 1.4 | 14% | 40.0 | 1.6 |
| Ex. 41 | 0 | 0 | 10.0 | 1.4 | 14% | 45.0 | 1.6 |
| Ex. 42 | 0 | 0 | 7.0 | 1.1 | 16% | 35.0 | 0.9 |
| Ex. 43 | 0 | 0 | 7.0 | 1.1 | 16% | 35.0 | 0.9 |
| Ex. 44 | 0 | 0 | 7.0 | 1.1 | 16% | 35.0 | 0.9 |
| Ex. 45 | 0 | 0 | 7.0 | 1.1 | 16% | 35.0 | 0.9 |

TABLE 2

| | Recording medium | Second ink receiving layer | | | | | First ink receiving layer | | |
|---|---|---|---|---|---|---|---|---|---|
| | | Film thickness μm | Alumina hydrate 1 parts by mass | Polyvinyl alcohol parts by mass | Boric acid parts by mass | B2/P2 | Film thickness μm | Alumina hydrate 1 parts by mass | Gas-phase-alumina 1 parts by mass |
| Comp. Ex. 1 | 46 | 25.0 | 100 | 11.0 | 1.5 | 14% | 10.0 | 100 | 0 |
| Comp. Ex. 2 | 47 | 25.0 | 100 | 11.0 | 1.5 | 14% | 10.0 | 100 | 0 |
| Comp. Ex. 3 | 48 | 25.0 | 100 | 11.0 | 1.5 | 14% | 10.0 | 100 | 0 |
| Comp. Ex. 4 | 49 | 25.0 | 100 | 11.0 | 1.5 | 14% | 10.0 | 100 | 0 |
| Comp. Ex. 5 | 50 | 25.0 | 100 | 10.0 | 1.5 | 15% | 10.0 | 100 | 0 |
| Comp. Ex. 6 | 51 | 25.0 | 100 | 19.0 | 1.5 | 8% | 10.0 | 100 | 0 |
| Comp. Ex. 7 | 52 | 25.0 | 100 | 11.0 | 1.3 | 12% | 10.0 | 100 | 0 |
| Comp. Ex. 8 | 53 | 25.0 | 100 | 11.0 | 3.0 | 27% | 10.0 | 100 | 0 |

| | First ink receiving layer | | | | | | |
|---|---|---|---|---|---|---|---|
| | Gas-phase-alumina 2 parts by mass | Gas-phase-alumina 3 parts by mass | Polyvinyl alcohol parts by mass | Boric acid parts by mass | B1/P1 | Total film thickness μm | (B2/P2)/(B1/P1) |
| Comp. Ex. 1 | 0 | 0 | 6.0 | 1.1 | 18% | 35.0 | 0.7 |
| Comp. Ex. 2 | 0 | 0 | 11.0 | 1.1 | 10% | 35.0 | 1.4 |
| Comp. Ex. 3 | 0 | 0 | 7.0 | 1.0 | 14% | 35.0 | 1.0 |
| Comp. Ex. 4 | 0 | 0 | 7.0 | 1.5 | 21% | 35.0 | 0.6 |
| Comp. Ex. 5 | 0 | 0 | 7.0 | 1.1 | 16% | 35.0 | 1.0 |
| Comp. Ex. 6 | 0 | 0 | 7.0 | 1.1 | 16% | 35.0 | 0.5 |
| Comp. Ex. 7 | 0 | 0 | 7.0 | 1.1 | 16% | 35.0 | 0.8 |
| Comp. Ex. 8 | 0 | 0 | 10.0 | 1.1 | 11% | 35.0 | 2.5 |

Evaluation:

The respective ink jet recording media were evaluates in the following manner.

Evaluation 1: Optical Density

A black solid image of 5×5 cm was recorded on each of the recording media by an ink jet recording apparatus (trade name: MP990, manufactured by Canon Inc., gloss gold, beautiful mode, no color correction). The optical density of a central portion of the solid image was measured by Gretag Spectrolino (manufactured by Gretag Macbeth Co.).

Evaluation 2: Ink Absorbency

An image was recorded on each of the ink jet recording media by an ink jet recording apparatus (the printing treatment method of MP990 was modified). The image was a 64-gradation solid image (64 gradations with an increment of 6.25% duty, 0 to 400% duty) by bi-directional printing in which printing is completed by reciprocating 2-pass scans at a carriage speed of 25 in/sec. Incidentally, the 400% duty means such a state that an ink was 4 times applied to all cells of a 600 dpi-square (a square of 1 square inch with 600 dpi). As a result, 44 ng of the ink comes to be applied.

Since the ink absorbency has correlation with beading, the ink absorbency of the recording medium was evaluated by evaluating the beading. Incidentally, the beading means a phenomenon in which adjoining ink droplets come into contact with each other to form a color-uneven image. The evaluation was visually made according to the following criteria.

Rank 5: No beading is observed at 350% duty;

Rank 4: Beading is observed at 350% duty, but no beading is observed at 300% duty;

Rank 3: Beading is observed at 300% duty, but no beading is observed at 250% duty;

Rank 2: Beading is observed at 250% duty, but no beading is observed at 200% duty;

Rank 1: Beading is observed at 150% duty.

Evaluation 3: Moisture Resistance

Images were recorded on each of the recording media by an ink jet recording apparatus (trade name: MP990, manufactured by Canon Inc., gloss gold, beautiful mode, no color correction). The images were reverse letters of "E" on a blue background with two sizes of 48 and 10 points. The images recorded were left to stand for 20 days under an environment of 30° C. in temperature and 90% in humidity. The degree of bleeding of the images to the reverse portion before and after left to stand was visually evaluated according to the following criteria.

Rank 5: No bleeding is observed in both 10-point and 48-point reverse letters, and the letters are clear;

Rank 4: No bleeding is observed in the 48-point reverse letter, and the letter is clear. On the other hand, bleeding is somewhat observed in the 10-point reverse letter, but the letter does not collapse;

Rank 3: Bleeding is somewhat observed in both 10-point and 48-point reverse letters, but both letters do not collapse;

Rank 2: Bleeding is observed in the 10-point reverse letter, and the letter partially breaks. On the other hand, bleeding is somewhat observed in the 48-point reverse letter, but the letter does not collapse.

Rank 1: Bleeding is considerably observed in both 10-point and 48-point reverse letters, and both letters partially collapse.

Evaluation 4: Conveyance-Caused Flaw Resistance

An ink jet recording apparatus (trade name: MP990, manufactured by Canon Inc.) was modified in such a manner that the pressure of conveying rollers can be adjusted from 1.5 kgf to 2.0 kgf. A black solid image was recorded on the whole surface of each of the recording media by means of this ink jet recording apparatus. Conveyance-caused flaw by the conveying rollers was visually evaluated according to the following criteria.

Rank 5: Flaw cannot be visually observed under a pressure of 2.0 kgf;

Rank 4: Flaw cannot be visually observed under a pressure of 1.8 kgf, but can be visually observed under a pressure of 2.0 kgf;

Rank 3: Flaw cannot be visually observed under a pressure of 1.7 kgf, but can be visually observed under a pressure of 1.8 kgf;

Rank 2: Flaw cannot be visually observed under a pressure of 1.5 kgf, but can be visually observed under a pressure of 1.7 kgf;

Rank 1: Flaw can be visually observed under a pressure of 1.5 kgf.

The results of the above-described evaluations are shown in Tables 3 and 4.

TABLE 3

| | | Evaluation result | | | |
|---|---|---|---|---|---|
| | Recording medium | O.D. of Bk solid image | Ink absorbency | Moisture resistance | Conveyance-caused flaw resistance |
| Ex. 1 | 1 | 2.25 | 3 | 2 | 2 |
| Ex. 2 | 2 | 2.25 | 3 | 3 | 3 |
| Ex. 3 | 3 | 2.25 | 3 | 3 | 3 |
| Ex. 4 | 4 | 2.26 | 3 | 3 | 3 |
| Ex. 5 | 5 | 2.25 | 4 | 2 | 3 |
| Ex. 6 | 6 | 2.26 | 2 | 4 | 3 |
| Ex. 7 | 7 | 2.25 | 2 | 4 | 2 |
| Ex. 8 | 8 | 2.26 | 2 | 5 | 2 |
| Ex. 9 | 9 | 2.26 | 3 | 3 | 3 |
| Ex. 10 | 10 | 2.27 | 3 | 3 | 3 |
| Ex. 11 | 11 | 2.25 | 4 | 3 | 4 |
| Ex. 12 | 12 | 1.98 | 4 | 3 | 3 |
| Ex. 13 | 13 | 2.27 | 4 | 3 | 4 |
| Ex. 14 | 14 | 2.22 | 2 | 4 | 3 |
| Ex. 15 | 15 | 2.24 | 3 | 4 | 3 |
| Ex. 16 | 16 | 2.27 | 3 | 4 | 2 |
| Ex. 17 | 17 | 2.25 | 3 | 3 | 3 |
| Ex. 18 | 18 | 2.27 | 3 | 3 | 2 |
| Ex. 19 | 19 | 2.26 | 2 | 4 | 3 |
| Ex. 20 | 20 | 2.27 | 3 | 3 | 2 |
| Ex. 21 | 21 | 2.25 | 3 | 4 | 3 |
| Ex. 22 | 22 | 2.25 | 3 | 3 | 3 |
| Ex. 23 | 23 | 2.25 | 4 | 3 | 4 |
| Ex. 24 | 24 | 2.25 | 5 | 3 | 4 |

TABLE 3-continued

| | | Evaluation result | | | |
|---|---|---|---|---|---|
| | Recording medium | O.D. of Bk solid image | Ink absorbency | Moisture resistance | Conveyance-caused flaw resistance |
| Ex. 25 | 25 | 2.27 | 4 | 3 | 4 |
| Ex. 26 | 26 | 2.27 | 4 | 3 | 2 |
| Ex. 27 | 27 | 2.27 | 3 | 4 | 3 |
| Ex. 28 | 28 | 2.27 | 3 | 4 | 3 |
| Ex. 29 | 29 | 2.27 | 3 | 4 | 3 |
| Ex. 30 | 30 | 2.27 | 2 | 4 | 4 |
| Ex. 31 | 31 | 2.27 | 5 | 3 | 4 |
| Ex. 32 | 32 | 2.26 | 5 | 3 | 5 |
| Ex. 33 | 33 | 2.20 | 5 | 3 | 5 |
| Ex. 34 | 34 | 2.13 | 5 | 3 | 5 |
| Ex. 35 | 35 | 2.12 | 5 | 3 | 5 |
| Ex. 36 | 36 | 2.26 | 4 | 3 | 4 |
| Ex. 37 | 37 | 2.26 | 4 | 3 | 4 |
| Ex. 38 | 38 | 2.19 | 5 | 3 | 5 |
| Ex. 39 | 39 | 2.27 | 5 | 5 | 5 |
| Ex. 40 | 40 | 2.27 | 5 | 5 | 5 |
| Ex. 41 | 41 | 2.26 | 5 | 5 | 4 |
| Ex. 42 | 42 | 2.27 | 3 | 2 | 3 |
| Ex. 43 | 43 | 2.25 | 3 | 2 | 3 |
| Ex. 44 | 44 | 2.26 | 3 | 3 | 2 |
| Ex. 45 | 45 | 2.28 | 3 | 3 | 2 |

TABLE 4

| | | Evaluation result | | | |
|---|---|---|---|---|---|
| | Recording medium | O.D. of Bk solid image | Ink absorbency | Moisture resistance | Conveyance-caused flaw resistance |
| Comp. Ex. 1 | 46 | 2.23 | 4 | 2 | 1 |
| Comp. Ex. 2 | 47 | 2.22 | 1 | 3 | 3 |
| Comp. Ex. 3 | 48 | 2.24 | 2 | 2 | 1 |
| Comp. Ex. 4 | 49 | 2.26 | 3 | 1 | 2 |
| Comp. Ex. 5 | 50 | 2.25 | 3 | 2 | 1 |
| Comp. Ex. 6 | 51 | 2.25 | 1 | 3 | 2 |
| Comp. Ex. 7 | 52 | 2.27 | 2 | 2 | 1 |
| Comp. Ex. 8 | 53 | 2.27 | 3 | 1 | 4 |

It is understood from Tables 3 and 4 that the ink jet recording media of Examples 1 to 45 are good in all of the ink absorbency, moisture resistance and conveyance-caused flaw resistance. On the other hand, the ink jet recording medium of Comparative Example 1, in which the content of polyvinyl alcohol in the first ink receiving layer is low, is low in the conveyance-caused flaw resistance. The ink jet recording medium of Comparative Example 2, in which the content of polyvinyl alcohol in the first ink receiving layer is high, is low in the ink absorbency. The ink jet recording medium of Comparative Example 3, in which the content of boric acid in the first ink receiving layer is low, is low in the conveyance-caused flaw resistance. The ink jet recording medium of Comparative Example 4, in which the content of boric acid in the first ink receiving layer is high, is low in the moisture resistance. The ink jet recording medium of Comparative Example 5, in which the content of polyvinyl alcohol in the second ink receiving layer is low, is low in the conveyance-caused flaw resistance. The ink jet recording medium of Comparative Example 6, in which the content of polyvinyl alcohol in the second ink receiving layer is high, is low in the ink absorbency. The ink jet recording medium of Comparative Example 7, in which the content of boric acid in the second ink receiving layer is low, is low in the conveyance-caused flaw resistance. The ink jet recording medium of Comparative Example 8, in which the content of boric acid in the second ink receiving layer is low, is high in the moisture resistance.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-027544, filed Feb. 10, 2011, which is hereby incorporated by reference herein in its entirety.

What is claimed is:

1. An ink jet recording medium comprising a substrate and two or more ink receiving layers provided on the substrate, wherein a first ink receiving layer that is an outermost ink receiving layer of the two or more ink receiving layers and a second ink receiving layer adjacent to the first ink receiving layer contain an alumina pigment, polyvinyl alcohol and boric acid, the first ink receiving layer contains polyvinyl alcohol in an amount of 7.0% by mass or more and 10.5% by mass or less based on the alumina pigment and contains boric acid in an amount of 1.1% by mass or more and 1.4% by mass or less based on the alumina pigment, and the second ink receiving layer contains polyvinyl alcohol in an amount of 10.5% by mass or more and 17.0% by mass or less based on the alumina pigment and contains boric acid in an amount of 1.5% by mass or more and 2.5% by mass or less based on the alumina pigment.

2. The ink jet recording medium according to claim 1, wherein when the polyvinyl alcohol content based on the alumina pigment and the boric acid content based on the alumina pigment in the first ink receiving layer are regarded as P1 and B1, respectively, and the polyvinyl alcohol content based on the alumina pigment and the boric acid content based on the alumina pigment in the second ink receiving layer are regarded as P2 and B2, respectively, (B2/P2)/(B1/P1) is 1.0 or more and 2.1 or less.

3. The ink jet recording medium according to claim 1, wherein the first ink receiving layer contains alumina hydrate and gas-phase-process alumina as the alumina pigment.

4. The ink jet recording medium according to claim 1, wherein a film thickness of the first ink receiving layer is 6.5 μm or more and 18.0 μm or less, and a film thickness of the second ink receiving layer is 25.0 μm or more and 35.0 μm or less.

5. The ink jet recording medium according to claim 1, wherein the first ink receiving layer contains alumina hydrate and gas-phase-process alumina as the alumina pigment, and the second ink receiving layer contains alumina hydrate as the alumina pigment.

6. The ink jet recording medium according to claim 5, wherein a ratio of the alumina hydrate to the gas-phase-process alumina in the first ink receiving layer is 85:15 to 75:25 in terms of mass ratio.

7. The ink jet recording medium according to claim 2, wherein (B2/P2)/(B1/P1) is 1.4 or more and 1.9 or less.

8. The ink jet recording medium according to claim 7, wherein:

the film thickness of the first ink receiving layer is 6.5 μm or more and 18.0 μm or less, and the film thickness of the second ink receiving layer is 25.0 μm or more and 35.0 μm or less, the first ink receiving layer contains alumina hydrate and gas-phase-process alumina as the alumina pigment, and the second ink receiving layer contains alumina hydrate as the alumina pigment, and a ratio of the alumina hydrate to the gas-phase-process alumina in the first ink receiving layer is 85:15 to 75:25 in terms of mass ratio.

* * * * *